United States Patent [19]

Wiebe et al.

[11] Patent Number: 4,719,789

[45] Date of Patent: Jan. 19, 1988

[54] CRIMPING TOOL

[75] Inventors: Ulrich Wiebe, Dörentrup; Manfred Wilmes, Detmold, both of Fed. Rep. of Germany

[73] Assignee: C.A. Weidmuller GmbH & Co., Detmold, Fed. Rep. of Germany

[21] Appl. No.: 885,191

[22] Filed: Jul. 14, 1986

[30] Foreign Application Priority Data

May 21, 1986 [SE] Sweden ..... 8602301

[51] Int. Cl.[4] ..... B21D 7/06; B21D 53/36

[52] U.S. Cl. ..... 72/410; 7/107; 29/751; 72/416; 72/461; 81/421; 81/426.5

[58] Field of Search ..... 7/107; 29/751, 758, 29/876, 883; 72/410, 409, 412, 416, 359, 461; 81/421, 426.5

[56] References Cited

U.S. PATENT DOCUMENTS

| | | | |
|---|---|---|---|
| 2,205,893 | 6/1940 | Unger | 72/416 |
| 3,146,519 | 9/1964 | Redwine | 72/416 |
| 3,553,999 | 1/1971 | Rommel | 72/410 |
| 3,571,888 | 3/1971 | Filippo | 29/751 |
| 4,132,101 | 1/1979 | Abramson | 72/416 |
| 4,192,171 | 3/1980 | Hamilton | 72/416 |
| 4,561,282 | 12/1985 | Hadden | 72/410 |
| 4,590,786 | 5/1986 | Wiener et al. | 72/410 |
| 4,637,242 | 1/1987 | Undin et al. | 72/410 |

FOREIGN PATENT DOCUMENTS

| | | | |
|---|---|---|---|
| 1522144 | 8/1978 | United Kingdom | 72/410 |

*Primary Examiner*—Robert L. Spruill
*Assistant Examiner*—Donald R. Studebaker
*Attorney, Agent, or Firm*—Cushman, Darby & Cushman

[57] ABSTRACT

A tool for crimping terminals onto the ends of electrical conductors so that a cross-sectional shape of a four-tipped star is obtained comprises in a pair of die carriers at least one pair of co-operating die elements, each die element comprising a central indentation and each pair of die elements further comprising at least two lateral cut-in portions so that a crimping space in the shape of star with four tips is obtained wherein the two indentations define two of the tips, and the two cut-in portions define the other two tips, extending transversely to the first ones.

13 Claims, 5 Drawing Figures

CRIMPING TOOL

FIELD OF THE INVENTION

The invention relates to crimping tools for electrical terminals producing a crimp with the general cross-sectional shape of a star having four tips. This manner of crimping is often used with terminals or connectors of the plug type.

BACKGROUND OF THE INVENTION

A tool producing a result of this kind is described e.g. in the U.S. Pat. No. 2,933,000. The tool has a pair of handles and four forming pins or plungers which are radially movable within a circular opening in the body into which the terminal (cable shoe) with the electrical conductor onto which it shall be crimped may be introduced. With the aid of a driving mechanism, which itself is driven by a movable handle in said pair of handles, the said forming pins or indenters are from the periphery of said opening from four sides pressed into the terminal, forming there four indentations separated one from the other by projecting portions defining the tips in the said cross-sectional shape of the terminal when crimped onto the conductor. There is no means in said opening (which is considerably larger than the cross-section of the uncrimped terminal) against which the expanding "tips" may abut.

It will be readily recognized that the said driving mechanism, regardless according to which principle it is constructed and works, necessarily is rather complex, as the swingning movement of one handle must be transformed to a translatorial movement of four pins attacking the terminal from four different, and partly right opposite directions, and at the same time must be rather robust, because the said pins have to deform the terminal and compress the conductor inserted therein. Moreover, the movable forming pins easily may become blocked by dirt etc. Further, "pockets" may be formed between the conductor and the ends of the tips where no counter-pressure is met.

OBJECTS OF THE INVENTION

It is an object of the present invention to provide a tool of the kind aforesaid in which the need of a complex and at the same time robust driving mechanism for movable pins is eliminated as well as such pins themselves. Another object of the invention is to achieve that at the end of the crimping operation the terminal is continuously surrounded by a surface defining a counter-pressure means and preventing the formation of pockets by inducing the terminal to compress the inserted conductor from all radial directions.

SUMMARY OF THE INVENTION

This object and others which will become apparent hereinafter are attained with a tool for crimping terminals onto the ends of electrical conductors in such a manner that a cross-sectional shape of generally a star with four tips is obtained, which tool comprises a pair of rigid die carriers movable from an open position where the die carriers are spaced one from another into a closed position defined by an end stop means and in which the die carriers are adjacent one another, each said die carrier having an inner edge which faces the inner edge of the other die carrier; a mounting means for mounting said die carriers one opposite the other, and a driving means for driving said die carriers in their said movement. At each said inner edge there is provided at least one crimping die element aligned with the crimping die element in the other die carrir to define therewith a pair of co-operating dies, each said die element comprising an indentation extending in the direction of said movements and terminated by a dead end. Each said pair comprises at least two lateral cut-in portions extending transversely to the direction of said movement at opposite sides from at least one of said indentations, and at least two terminal means at the ends of opposite lateral cut-in portions, the ends of all cut-in portions being equally spaced from said indentations. Said die pair defines thus, in said closed position, a crimping space in the shape of a four-tipped star with two tips terminated by said dead ends, and two tips terminated by said terminal means. Thus, the crimping space is continuously, i.e. without interruption, surrounded by a counter-pressure surface. Preferably, the die elements in both said carriers have said two cut-in lateral portions (although the not all lateral portions need to be terminated by said terminal means). One die element may be arranged at the bottom of a recess in the respective inner edge, and the other said element may be arranged at the top of a projection from the respective inner edge, said projection being introducible into said recess to a depth defined by said end stop means.

Said terminal ends are arranged at at least two opposite locations and may be defined by a concave rounding-off pointing toward the die element in the other carrier. By "opposite" is in this case meant opposite in the direction transverselly to the direction of said movements. The indentations may taper toward said dead ends thereof, and/or the lateral portions may taper toward said terminal means thereof.

The distance between the two dead ends may in said closed position generally be equal to the distance between the said two terminal means, so that the shape of a star with four equally long tips is obtained. However, said crimping space may generally have a greater width in the two tips extending transversally to said direction of movements than in the two tips extending parallel with said direction. Said crimping space has preferably further rounded-off corners at the locations where said indentation or indentations meet the lateral portions.

BRIEF DESCRIPTION OF THE DRAWINGS

Other features and objects of the invention will be readily apparent from the following specifications and appended drawings which refer to exemplary embodiments and in which.

Figure 1:
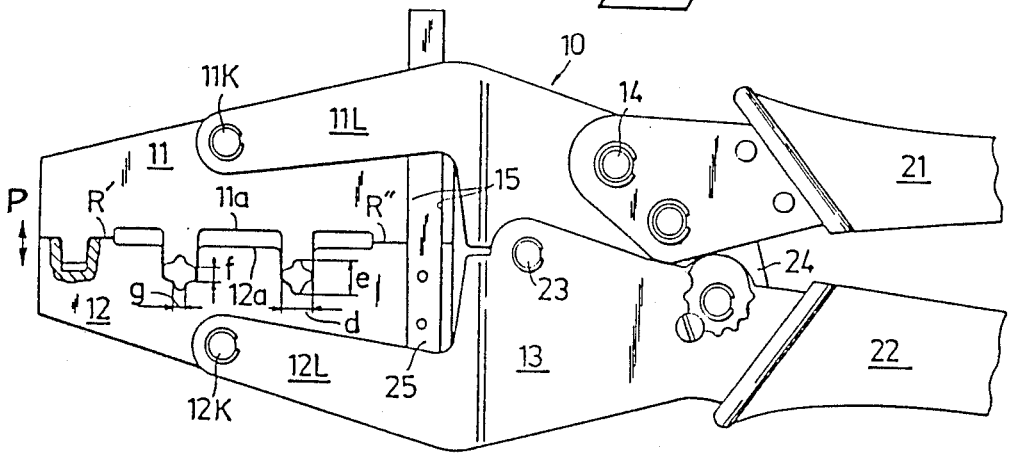
FIG. 1 is a side view of a first embodiment of the tool of the invention.
Figure 2:
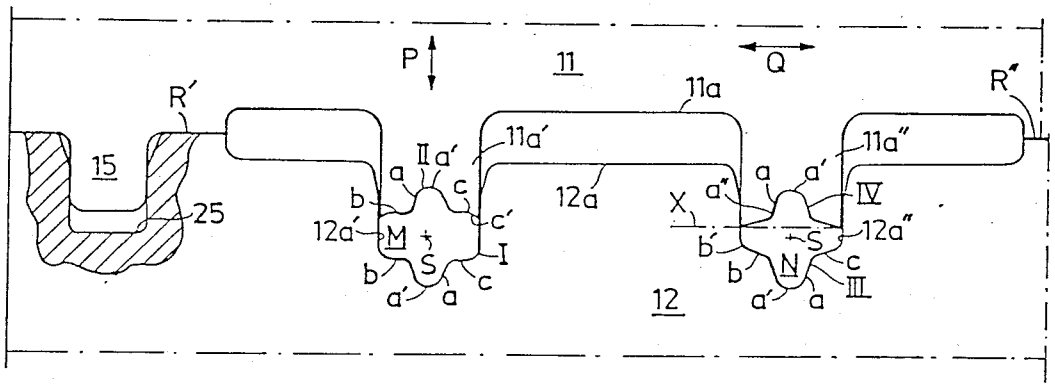
FIG. 2 shows at a larger scale the front part of the tool of FIG. 1.

According to FIGS. 1 and 2, a pair of crimping pliers 10 comprises a pair of jaws 11, 12 defining a pair of die carriers. The jaws 11, 12 are by means of pivot pins 11K, 12K pivotally suspended on arms 11L, 12L which in their turn are pivoted one to another with the aid of a pivot pin 23. The tool 10 has further a pair of handles 21, 22, the handle 22 being integrated with the arm 12 to a rigid tool body 13. The arm 11L is by means of another pivot pin 14 pivoted to the handle 21 which in its turn is with the aid of an interposed link 24 pivotally connected to the tool body 13. To the jaw 12 is rigidly connected a straight guiding rod 25 which glides in a rectilinear groove 15 in the jaw 11, so that upon operation of the handle 21, which defines a driving means for the movement of the two jaws 11, 12, these jaws are parallelly approached one to another or spaced one from another.

The arms 11L, 11K and the pivot pin 23 define mounting means for the jaws or die carriers 11, 12. The jaws 11, 12 have respective inner edges 11*a*, 12*a* which face one another and in the closed position of the jaws 11, 12, shown in the drawing, lie closely adjacent one another.

At the inner edge 12*a* are two recesses 12*a'*, 12*a''* provided, the bottoms of which are shaped to define crimping die elements I and III. From the inner edge 11*a* protrude two projections 11*a'*, 11*a''* the tops of which are shaped to define crimping die elements II and IV. The projections 11*a'*, 11*a''* are aligned—in the direction of the movement P—with the recesses 12*a'*, 12*a''* and dimensioned so as to be receivable therein. Two pairs I/II and III/IV of co-operating dies are thus obtained.

All die elements I–IV have a central indentation a extending in the direction P and terminated by a rounded-off dead end a'. All die elements I–IV has also two lateral cut-in portions b,c, extending at both sides from the respective indentation a. By "cut-in" is in the present context meant a contour which is concave relative a straight line, such as X, connecting the outer ends of the two lateral portions.

The lateral portions b, c in the die elements I–III have at their outer ends a terminal means embodied by a concave rounding-off such as b' or c' pointing toward the die element in the other jaw. In the die element IV are no special terminal means provided, and the lateral portions b and c are there terminated by a simple end point. It will be recognised that an alternative solution is to let in the die pair III/IV one lateral portion of the die element III terminate in an end point, and have the adjacent lateral portion in the die element IV terminated by a terminal means such as a rounding-off. It will be appreciated that in both cases, i.e. the one shown in the drawing, and the alternative just discussed, there always will be at least one terminal means at each of two opposite locations in the direction (arrow Q) transversely to the direction (arrow P) of the movement of the jaws, i.a. at the right hand end and at the left hand end of the pair of dies ("right" and "left" referring to the presentation in the drawings). The corners at which the indentations a meet the lateral portions b, c are convexly rounded-off as shown in the die element IV at a''.

The end position of the jaws 11, 12, shown in the drawings, is defined by an end stop means which in the present example is embodied by the inner edges 11*a*, 12*a* themselves which bear one against another at locations such as at R' and R'' where no other means are provided. A centering nose 15 is arranged on the jaw 11 for co-operation with a recess 25 in the jaw 12 to further promote strict alignement in the final phase of a crimping operation.

From the drawings is evident that in the closed position of the jaws 11, 12 the die pairs I/II and III/IV define crimping spaces M, N which have the shape of a star with four tips. The ends of two opposite tips are defined by said dead ends a', and the ends of the two other opposite tips are defined by said terminal means b' and c'. Preferably, and as shown in FIG. 1, the distances d, e between the two ends in said two pairs of ends are equal. The widths of the "tips" may be substantially equal—as shown in the space N—or the width f in one direction, preferably parallel with the direction of movement P, may be broader than the width g in the other direction, as shown in the crimping space M.

Figure 3:
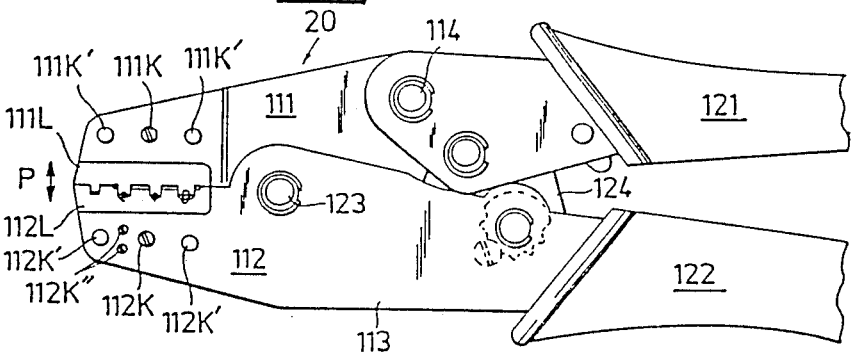
FIG. 3 is a side view of a second embodiment of the tool of the invention.
Figure 4:
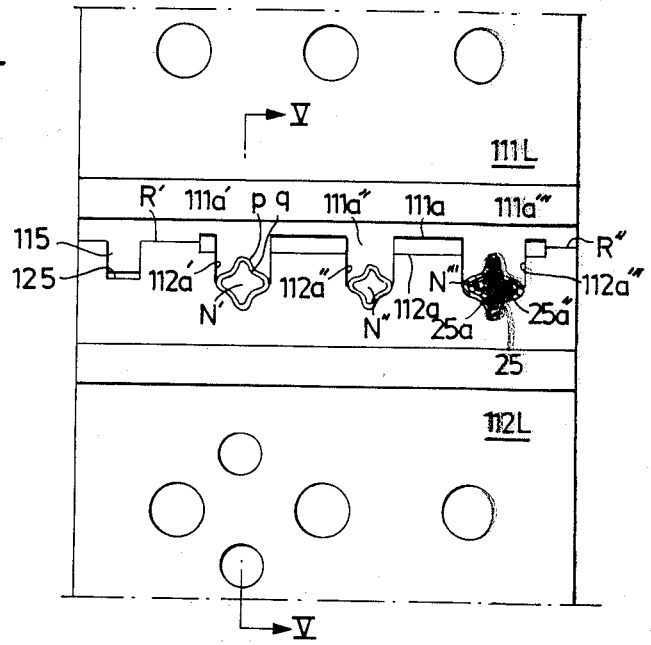
FIG. 4 shows at a larger scale a pair of insert plates of the tool of FIG. 3
Figure 5:
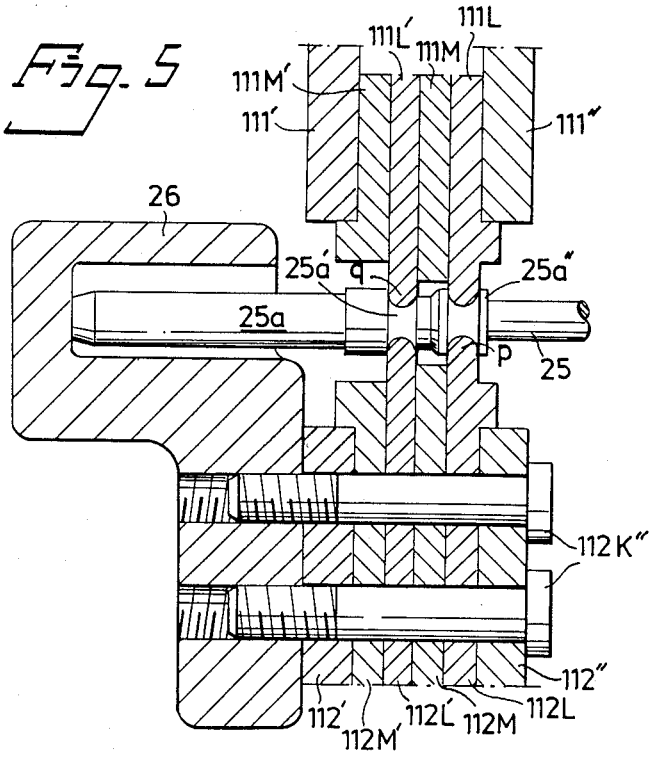
FIG. 5 is a cross-sectional view at a larger scale along the plane V—V in FIG. 4.

According to FIGS. 3 to 5, a pair of crimping pliers 20 has two jaws 111, 112 defining a pair of die carriers, and a pair of handles 121, 122. The jaw 112 and the handle 122 are integrated to define a rigid tool body 113. The jaw 111 is pivoted to the tool body 113 by means of a pivot pin 123 which defines a means for mounting the two die carriers 111, 112 one relative another in such a manner that jaw 112 may be moved to-and-from jaw 111 in both senses of the arrow P. The jaw 111 is with the aid of another pivot pin 114 pivoted to the handle 121 which in its turn is with the aid of a link 124 pivotally connected to the tool body 113. The handle 121 defines a driving means for moving the jaws 111, 112 in the senses of the arrow P. The die carriers are defined by insert plates 111L, 112L which are mounted for ready replacement, but rigidly, in the jaws 111, 112 with the aid of screws 111K, 112k and bolts 111K' and 112K' passing through holes provided to this purpose in the plates. In analogy to FIGS. 1 and 2, the insert plates 111L, 112L have inner edges 111*a*, 112*a* and at the edge 112*a* there are provided three recesses 112*a'*, 112*a''*, 112*a'''*, the bottoms of which are shaped to define crimping die elements in analogy to the elements I and III of FIG. 2. From the inner edge 111*a* protrude three projections 111*a'*, 111*a''* and 111*a'''* the tops of which are shaped to define crimping die elements in analogy to the element II of FIG. 2. Three pairs of co-operating die elements in analogy to the pairs I/III and II/IV of FIG. 2 are thus obtained which define differently dimensioned crimping spaces N', N'' and N'''. It will be realized that, in distinction to the die pair II/IV of FIGS. 1 and 2, in FIG. 4 have both die elements in each pair terminal means (concave rounding-offs).

In the crimping space N''' there is shown a cable shoe 25*a* with an insulated portion 25*a''* crimped upon a conductor 25.

From a study of FIG. 5 will be realized that each insert plate 111L, 112L is associated with an adjacent and parallel insert plate 111L', 112L' spaced by a spacer plate 111M, 112M. The jaws 111, 112 are made of two spaced side plates 111', 111'' and 112, 112'' between which the said insert and spacer plates, and a further pair of spacer plates 111M', 112M', are sandwiched. In both adjacent insert plates 111L, 111L' and 112L, 112L' are identically shaped die elements provided, but the die elements in the plates 111L' and 112L' define somewhat larger crimping spaces than in the plates 111L and 112L. These spaces are provided for crimping an insulated portion 25*a''* of a terminal 25*a* into which an electrical conductor 25 is inserted, and whose uninsulated crimping portion 25*a'* will be crimped by the die elements in the plates 111L, 112L.

The periphery of the die elements which define the smaller crimping space (i.e. the crimping space in the plates 111L and 112L) is in the FIGS. 4 and 5 marked q, and the periphery of the die elements which define the larger crimping space associated therewith (i.e. in the plates 111L' and 112L') is marked p.

What is claimed is:

1. In a tool for crimping terminals onto ends of electrical conductors comprising a pair of rigid die carriers movable from an open position in which the die carriers are spaced one from another into a closed position defined by an end stop means and in which the die carriers are adjacent one another; an inner edge on each said die carrier facing an inner edge of the other die carrier; mounting means for mounting said die carriers one opposite the other; driving means for driving said die carriers in their said movement; at least one crimping die element at each said inner edge, defining with the crimping die element in the other die carrier a pair of co-operating dies;

an improvement for rendering said tool suitable to form a crimp having a cross-sectional shape of generally a star with four tips, said improvement comprising:

each said die element comprising an indentation extending in the direction of said movement and in alignment, in said closed position, with the indentation in the other die element, and terminated by a dead end;

said pair of co-operating dies comprising at least two lateral cut-in portions extending transversely to the direction of said movement at opposite ends of an associated indentation, and at least two terminal means at the ends of opposite lateral cut-in portions;

the ends of all lateral cut-in portions being equally spaced from said associated indentation;

said pair of co-operating dies defining thus in said closed position a crimping space surrounded continuously by a counter-pressure surface and having the shape of a star with four tips, two opposite tips being defined by the two indentations, and the other two opposite tips being defined by said lateral cut-in portions.

2. The tool of claim 1, wherein one of said die elements is arranged at the bottom of a recess in the respective inner edge, and the other said die element is arranged at the top of a projection from the respective inner edge, said projection being introducible into said recess to a depth defined by said end stop means.

3. The tool of claim 1, wherein the die elements in both said carriers have said two lateral cut-in portions.

4. The tool of claim 1, wherein said terminal means are at at least two opposite locations in the direction transversely to the direction of the said movement defined by a concave rounding-off pointing toward the die element in the other carrier.

5. The tool of claim 1, wherein said indentations taper towards said dead ends thereof.

6. The tool of claim 1, wherein said lateral portions taper toward said terminal means thereof.

7. The tool of claim 1, wherein the distance between the two dead ends in said closed position is generally equal to the distance between the said two terminal means.

8. The tool of claim 1, wherein said crimping space generally has a greater width in the two tips extending transversely to the said direction of movement than in the two tips extending parallel with said direction.

9. The tool of claim 1, wherein said crimping space has rounded-off corners at the locations where said associated indentations meet the lateral cut-in portions.

10. The tool of claim 1, wherein a plurality of different die pairs is provided in one pair of jaws.

11. The tool of claim 1, wherein adjacently and in alignment with each said die element an analogically shaped larger die element is provided for crimping the insulated portion in terminals provided therewith.

12. The tool of claim 1, wherein the die carriers are embodied by die-carrier-plates which are insertable into the jaws of a pliers-like or vice-like tool.

13. The tool of claim 1, wherein a locator means for the terminals to be crimped is attached to one of said jaws.

* * * * *